US006539637B1

(12) United States Patent
Hollabaugh

(10) Patent No.: US 6,539,637 B1
(45) Date of Patent: Apr. 1, 2003

(54) MULTI-DISTANCE BOW SIGHT

(76) Inventor: Gregory L. Hollabaugh, 17802 John Brown Rd., Guys Mills, PA (US) 16327

( * ) Notice: Subject to any disclaimer, the term of this patent is extended or adjusted under 35 U.S.C. 154(b) by 0 days.

(21) Appl. No.: 10/036,207

(22) Filed: Dec. 24, 2001

(51) Int. Cl.[7] ..... F41G 1/467
(52) U.S. Cl. ..... 33/265; 124/87; 33/298
(58) Field of Search ..... 33/265, 297, 298; 124/87

(56) References Cited

U.S. PATENT DOCUMENTS 3,058,221 A * 10/1962 McNeel ..... 33/265
3,136,063 A * 6/1964 Stebbins ..... 124/87
3,696,517 A * 10/1972 Larson ..... 33/265
4,535,544 A * 8/1985 Jones et al. ..... 33/265
5,165,178 A * 11/1992 Seely ..... 33/265
5,220,907 A * 6/1993 Lonsdale ..... 124/87
5,464,003 A * 11/1995 Sherman ..... 124/87
5,511,318 A * 4/1996 Logan ..... 33/298
5,784,182 A * 7/1998 Francoeur et al. ..... 359/1
6,073,352 A * 6/2000 Zykan et al. ..... 33/265
6,098,608 A * 8/2000 Oshlick ..... 124/87
6,276,068 B1 * 8/2001 Sheliga ..... 33/265
6,463,665 B1 * 10/2002 Gomez-Vazquez ..... 33/265

* cited by examiner

*Primary Examiner*—G. Bradley Bennett
(74) *Attorney, Agent, or Firm*—Richard K Thomson

(57) ABSTRACT

A bow sight has a plurality of subassemblies adjustably attached to a main frame to permit vertical adjustment of the cross hairs. The subassemblies lie in different planes so that when the bow sight is used with a high powered, high speed bow, two or more of the cross hairs to be stacked or closely positioned, if necessary.

11 Claims, 3 Drawing Sheets

MULTI-DISTANCE BOW SIGHT

BACKGROUND AND SUMMARY OF THE INVENTION

The present invention is directed to a sight for bows. More particularly, the present invention is directed to a sighting mechanism that has a plurality of cross hairs for different distances in which two or more of the cross hairs may be stacked to provide zero gap there between.

Cross hair sights were historically quite popular for a number of reasons. First, the cross hairs, depending on their make up, obscure relatively little of the hunter's view. In addition, those having multiple cross hairs could be adjusted to afford different targeting sights for different distances. Further, cross hairs provide a readily visible targeting mechanism that can be seen in virtually any light. An example of such a bow sight is shown in U.S. Pat. No. 4,982,503 issued to Land. Land discloses a series of sight pins which are stacked in a track to provide targeting at, for example, 10 yards intervals out to 60 (or 100) yards.

Recently, however, with the introduction of more powerful, high speed bows, the inability of previous cross hair sights to permit stacking of one or more of the cross hairs has led to their falling into disfavor. In Land, for example, the closest that pins 38, 40 can be adjusted is a function of the width of the pin 38, 40. Since the high speed bows require narrower spacing for adjacent 10 yard intervals, the hunter is reduced to "guessing" and, in such a case, is often better off without a sight.

The present invention overcomes the shortfall of the prior art cross hair sights by providing a sight design that permits stacking of the adjacent cross hairs. The bow sight of the present invention comprises a rectangular main frame with a plurality of open channels on each side; means to attach said rectangular frame to a bow; a plurality of subassemblies movably mounted on said rectangular frame, each said subassembly including i) a sub-frame attached to said rectangular main frame, ii) a cross hair secured at each side of said sub-frame, iii) means to permit adjustment of a vertical position of said cross hair relative to said main frame, and iv) means to secure said cross hair in said adjusted position; a vertical windage hair for sighting with each of said cross hairs at one of a number of desired distances; whereby each of said sub-frames may be adjusted on said main frame to sight in its respective cross hair at one of said number of desired distances using said means to adjust said vertical position thereof and locked in place using said means to secure said cross hair. The sub-frames have sides with inwardly extending flanges that are slidably received in their respective open channels to permit vertical adjustment of the cross hairs. A nut and bolt combination permit clamping of the sub-frame in adjusted position relative to the main frame.

Preferably, each of the plurality of cross hairs is made of a different color monofilament line to facilitate use of the proper cross hair for the proper distance. The monofilament line is transparent/translucent so that the target is not obscured in any way. The sight, also, preferably has a level attached to a front edge of the main frame to enable the archer to ensure that the sight and bow are level prior to arrow release. The means for attaching the sight to the bow riser includes a conventional yoke that permits lateral adjustment of the sight to accommodate the preferences of the individual archer. The plurality of subassemblies is preferably three in number and can be readily adjusted to stack two or more of the cross hairs if use with a particular high speed bow warrants.

Various other features, advantages and characteristics of the bow sight of the present invention will become apparent after a reading of the following specification.

BRIEF DESCRIPTION OF THE DRAWINGS

The preferred embodiment(s) of the present invention is/are set forth in the drawings, like items bearing like reference numerals and in which.

DETAILED DESCRIPTION OF THE PREFERRED EMBODIMENT(S)

Figure 1:
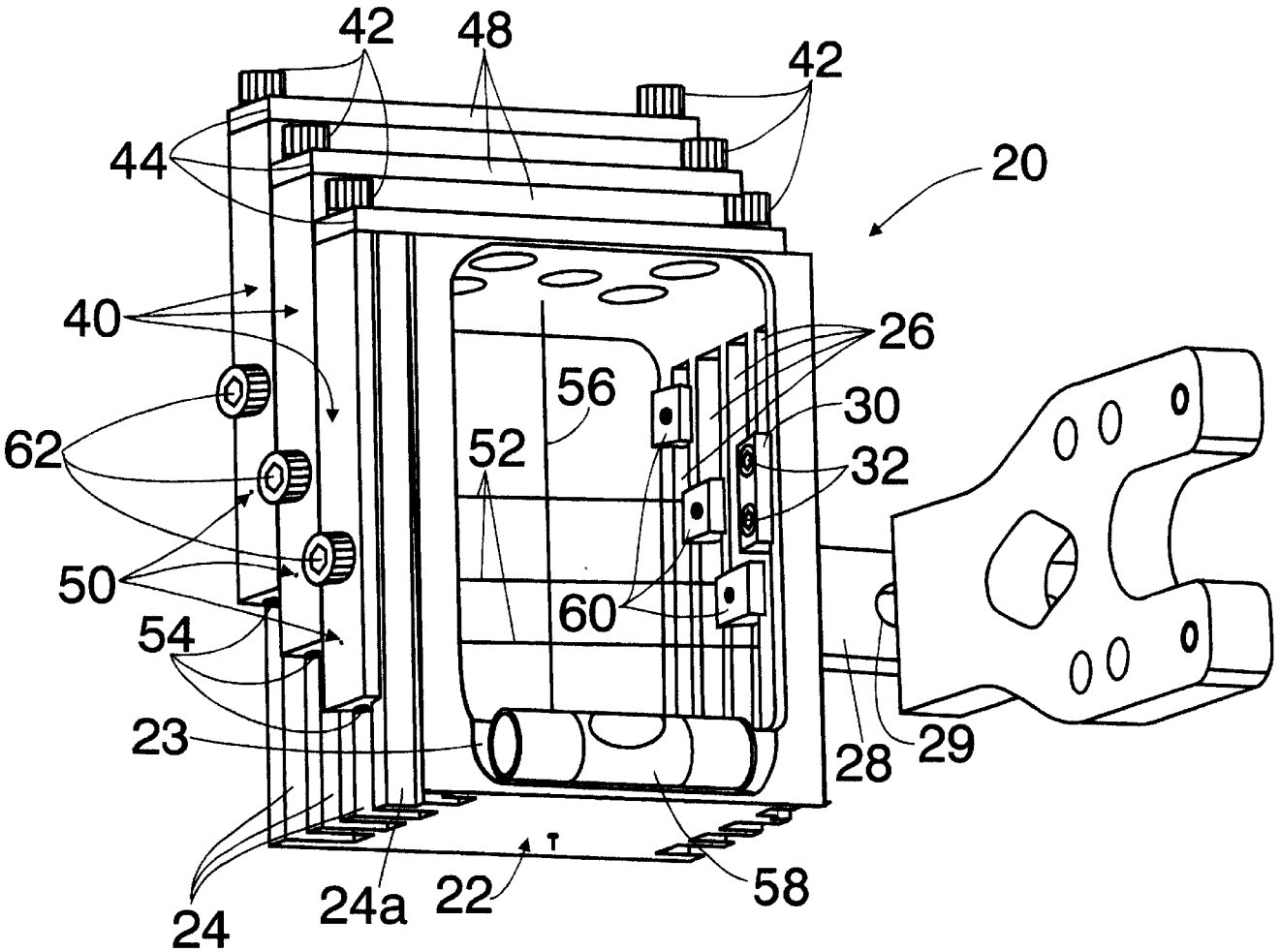
FIG. 1 is a perspective view of a first embodiment of the multi-distance bow sight of the present invention.
Figure 2:
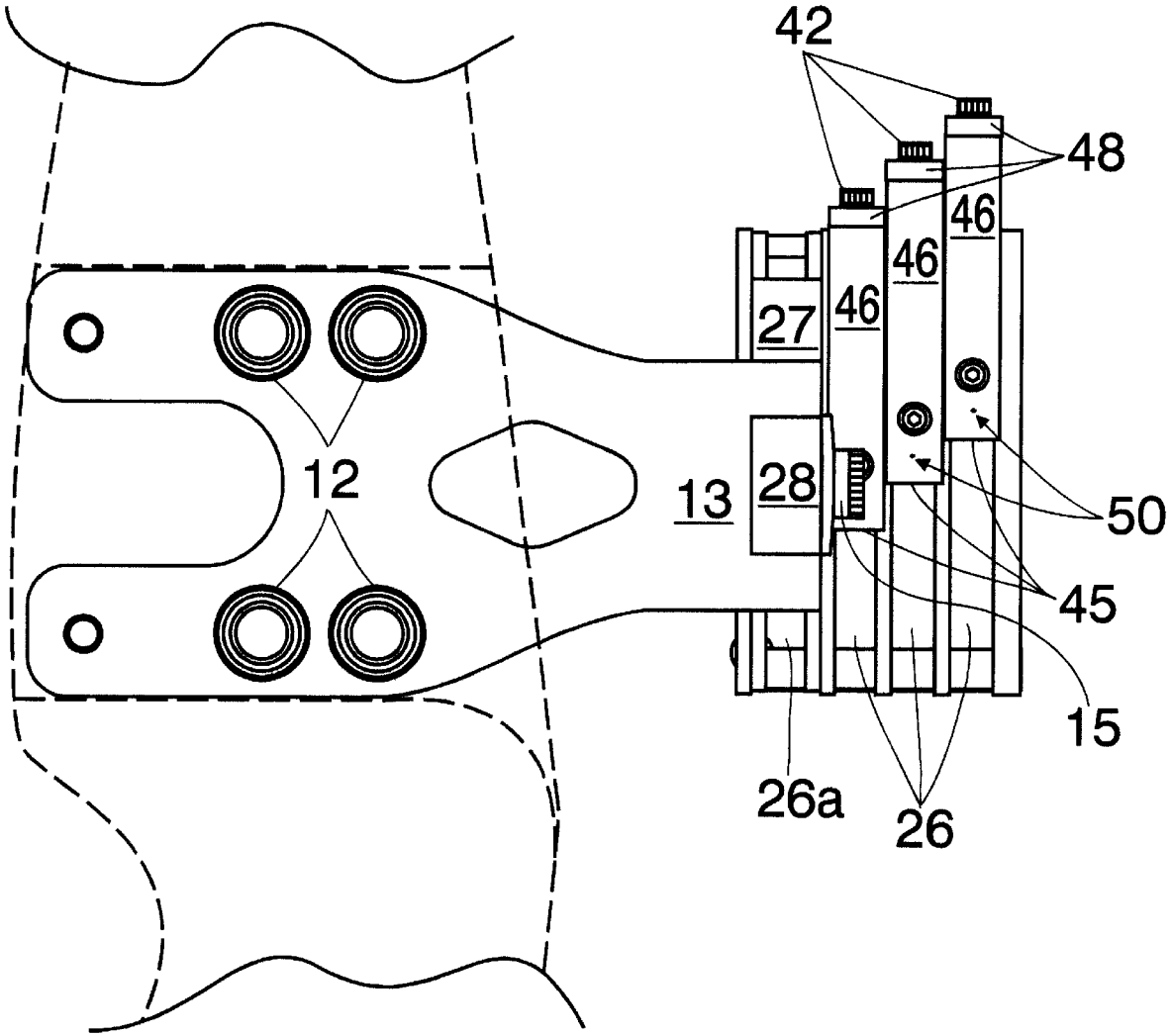
FIG. 2 is a side view of the first embodiment.
Figure 3:
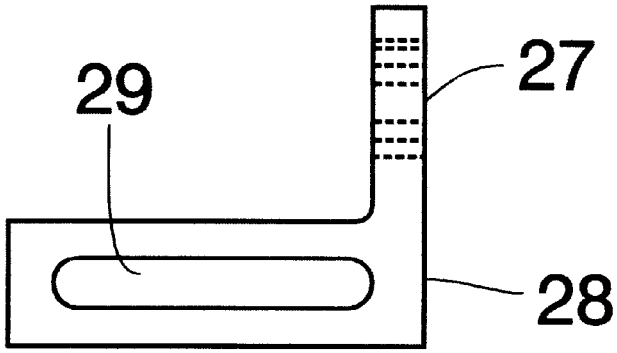
FIG. 3 is a side view of the mounting arm used in the present invention.

A first embodiment of the multi-distance bow sight of the present invention is shown in FIGS. 1 and 2 generally at 20. Bow sight 20 has a rectangular main frame 22 with open channels 24 and 26, respectively, extending along each side. Open channels 24 and 26 are open in both lateral directions. A conventional yoke 13 is attached to the rectangular main frame 22 at the forward most channel 24*a* for left handed archers and 26*a* for right handed archers using an L-shaped attachment arm 28 and clamp bar 30 using screws 32. Forwardmost channels 24*a* and 26*a* are notched to receive branch 27 of L-shaped arm 28 to ensure a solid connection to bow sight 20. The L-shaped attachment arm 28 permits significant adjustment to accommodate individual archer's preference of anchoring points when retracting the nocked arrow to full draw, even permitting inversion of attachment arm 28 if additional vertical adjustment is needed. A vertical windage hair 56 is centered in the top and bottom of main frame 22 and held there by epoxy, or the like. Likewise, a bubble level 58 is epoxied in a recess 23 formed in the front of the bottom of main frame 22 to permit the archer to ensure that the bow sight 20 and the bow 11 to which it is attached is held level as the arrow is released. Bow sight 20 may be attached to bow 11 by fastening screws (not shown) through countersunk holes 12 in yoke 13. Typically, only two screws are required through any two of the four holes 12.

Figure 4:
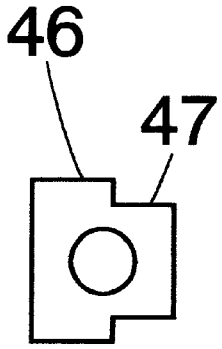
FIG. 4 is an end view of a side of a sub-frame of the first embodiment of the present invention.

A plurality of subassemblies 40 are movably mounted on main frame 22. Each subassembly includes a U-shaped subframe 44 having two side beams 46 and a lateral connecting beam 48 that is attached to the two side beams 46 by a pair of screws 42. As can be seen in FIG. 4, each side beam 46 is generally T-shaped with a protruding flange 47 that fits into channels 24 and 26 to permit vertical adjustment by sliding movement. Small holes 50, which are placed with precision with respect to the upper end of each side beam 46, receive cross hair 52. Preferably, the cross hairs 52 in each subassembly 40 is made of brightly colored monofilament line, each cross hair-having a different color to correspond with a particular target distance set by the archer. A set screw 54 is threaded into the lower end 45 of each side beam to engage and securely hold the filament which forms cross hair 52. Each subassembly 40 is secured in place on the main frame 22 by a nut 60 and bolt 62 to position its respective cross hair 52 at a position the archer determines provides a center target strike. The windage can be adjusted by sliding the main frame 22 and L-shaped attachment arm 28 relative to yoke 13. Locking screw 15 that is threaded into the end of yoke 13 can be loosened to permit yoke 13 to be slid laterally in slot 29 of attachment arm 28.

To use the bow sight 20 of the present invention, at least two screws are inserted through holes 12 in yoke 11. Windage may be adjusted by loosening locking screw 15 to laterally adjust bow sight 20 and L-shaped arm 28 relative to yoke 13. When windage hair 56 consistently places the arrow in the center region of the target, locking screw 15 is secured. Screws 62 can be loosened to permit subassemblies 40 to be vertically adjusted so that cross hairs 52 may be positioned for targeting at, for example, 20, 30 and 40 yards. The fact that subassemblies 40 lie in different planes means that if bow sight 20 is used with a high speed bow, two or more cross hairs 52 can be stacked should that be necessary for accurate targeting.

Various changes, alternatives, and modifications will become apparent after a reading of the foregoing specification. It is intended that all such changes, alternatives and modifications as fall within the scope of the appended claims be considered part of the present invention.

I claim:

1. A sight mechanism for a bow comprising a) a rectangular main frame with a plurality of open channels on each side;

b) means to attach said rectangular frame to a bow;

c) a plurality of subassemblies movably mounted on said rectangular main frame, each said subassembly including i) a sub-frame attached to said rectangular main frame;

ii) a cross hair secured at each side of said sub-frame;

iii) means to permit adjustment of a vertical position of said cross hair relative to said main frame;

iv) means to secure said cross hair in said adjusted position;

d) a vertical windage hair for sighting with each of said cross hairs at one of a number of desired distances;

whereby each of said sub-frames may be adjusted on said main frame to sight in its respective cross hair at one of said number of desired distances using said means to adjust said vertical position thereof and locked in place using said means to secure said cross hair.

2. The sight mechanism claim 1 wherein each sub-frame comprises an U-shaped member having two vertical beams interconnected by a lateral connecting beam.

3. The sight mechanism of claim 2 wherein said means to permit adjustment comprises a protruding flange extending inwardly from each said side beam of each sub-frame, said protruding flange being received in its respective open channel of said main frame.

4. The sight mechanism of claim 3 wherein said means to secure comprises a bolt extending through a hole in each said side beam which receives a nut to clamp said sub-frame to said main frame.

5. The sight mechanism of claim 1 wherein each cross hair on each sub-frame is of a different color.

6. The sight mechanism of claim 5 wherein each cross hair is made of a different brightly colored length of monofilament line.

7. The sight mechanism of claim 1 further comprising a level attached to a portion of said main frame to ensure proper orientation of said sight mechanism and the bow to which it is attached.

8. The sight mechanism of claim 1 wherein said means to attach said rectangular frame to a bow includes means to permit lateral adjustment of said sight mechanism to allow lateral adjustment.

9. The sight mechanism of claim 1 wherein said plurality of subassemblies comprises at least three subassemblies.

10. The sight mechanism of claim 1 wherein said plurality of subassemblies are mounted to permit alignment of said plurality of cross hairs to achieve zero gap there between.

11. A sight mechanism for a bow comprising a) a rectangular main frame with a plurality of open channels on each side;

b) means to attach said rectangular frame to a bow;

c) a plurality of subassemblies movably mounted on said rectangular main frame, each said subassembly including a cross hair and means to secure said cross hair in one of said plurality of open channels such that each one of said plurality of cross hairs lies in a different plane than each of said other cross hairs;

whereby said cross hairs may be closely positioned up to and including providing zero gap between at least two of said cross hairs.

* * * * *